US006676081B2

(12) United States Patent
Grabow et al.

(10) Patent No.: US 6,676,081 B2
(45) Date of Patent: Jan. 13, 2004

(54) SYSTEM FOR EXTINGUISHING AND SUPPRESSING FIRE IN AN ENCLOSED SPACE IN AN AIRCRAFT

(75) Inventors: Thomas Grabow, Emtinghausen (DE); Alexander Scheidt, Bremen (DE); Konstantin Kallergis, Bremen (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 10/282,333

(22) Filed: Oct. 28, 2002

(65) Prior Publication Data

US 2003/0136879 A1 Jul. 24, 2003

(30) Foreign Application Priority Data

Oct. 26, 2001 (DE) ..... 101 52 964

(51) Int. Cl.[7] ..... A62C 3/08
(52) U.S. Cl. ..... 244/129.2; 169/46; 169/62
(58) Field of Search ..... 244/129.2; 169/9, 169/11, 46, 62

(56) References Cited

U.S. PATENT DOCUMENTS

| | | | | |
|---|---|---|---|---|
| 3,893,514 A | | 7/1975 | Carhart et al. | |
| 4,351,394 A | * | 9/1982 | Enk | 169/61 |
| 4,566,542 A | | 1/1986 | Enk et al. | |
| 4,643,260 A | | 2/1987 | Miller | |
| 4,726,426 A | | 2/1988 | Miller | |
| 5,038,867 A | | 8/1991 | Hindrichs et al. | |
| 5,857,525 A | | 1/1999 | Okamoto et al. | |
| 5,957,210 A | | 9/1999 | Cohrt et al. | |
| 6,003,608 A | | 12/1999 | Cunningham | |
| 6,029,751 A | | 2/2000 | Ford et al. | |
| 6,053,256 A | * | 4/2000 | Lu | 169/46 |
| 6,082,464 A | | 7/2000 | Mitchell et al. | |
| 6,314,754 B1 | | 11/2001 | Kotliar | |
| 6,390,203 B1 | * | 5/2002 | Borisov et al. | 169/62 |
| 6,418,752 B2 | | 7/2002 | Kotliar | |

FOREIGN PATENT DOCUMENTS

| | | |
|---|---|---|
| DE | 4122446 | 1/1983 |
| DE | 19824300 | 10/1999 |
| DE | 10051662 | 5/2002 |
| EP | 0234056 | 9/1987 |

OTHER PUBLICATIONS

Grabow et al.; U. S. patent application Publication US 2002/0070035 A1, published on Jun. 13, 2002, entitled "Method and System for Extinguishing Fire in an Enclosed Space"; Cover Sheet, 1 sheet of drawings and pp. 1 to 4.

Wagner et al.; U. S. patent application Publication US 2002/0040940 A1, published on Apr. 11, 2002, entitled "Inerting Method and Apparatus for Preventing and Extinguishing Fires in Enclosed Spaces"; Cover Sheet, 2 sheets of drawings and pp. 1 to 3.

* cited by examiner

*Primary Examiner*—Robert P. Swiatek
(74) *Attorney, Agent, or Firm*—W. F. Fasse; W. G. Fasse

(57) ABSTRACT

A system for extinguishing and suppressing a fire in an enclosed space includes a Halon storage container and a nitrogen generator that are both connected by a duct system to extinguishing nozzles arranged in the enclosed space. Halon is supplied as a first extinguishing agent from the container to achieve a rapid initial extinguishing of the fire. Nitrogen enriched air is supplied as a second extinguishing agent from the nitrogen generator to achieve a continuous long-term fire suppression, commencing simultaneously with or after the introduction of the Halon. The nitrogen generator may include a molecular sieve to continuously generate the nitrogen enriched air from an inlet flow of environmental air.

25 Claims, 1 Drawing Sheet

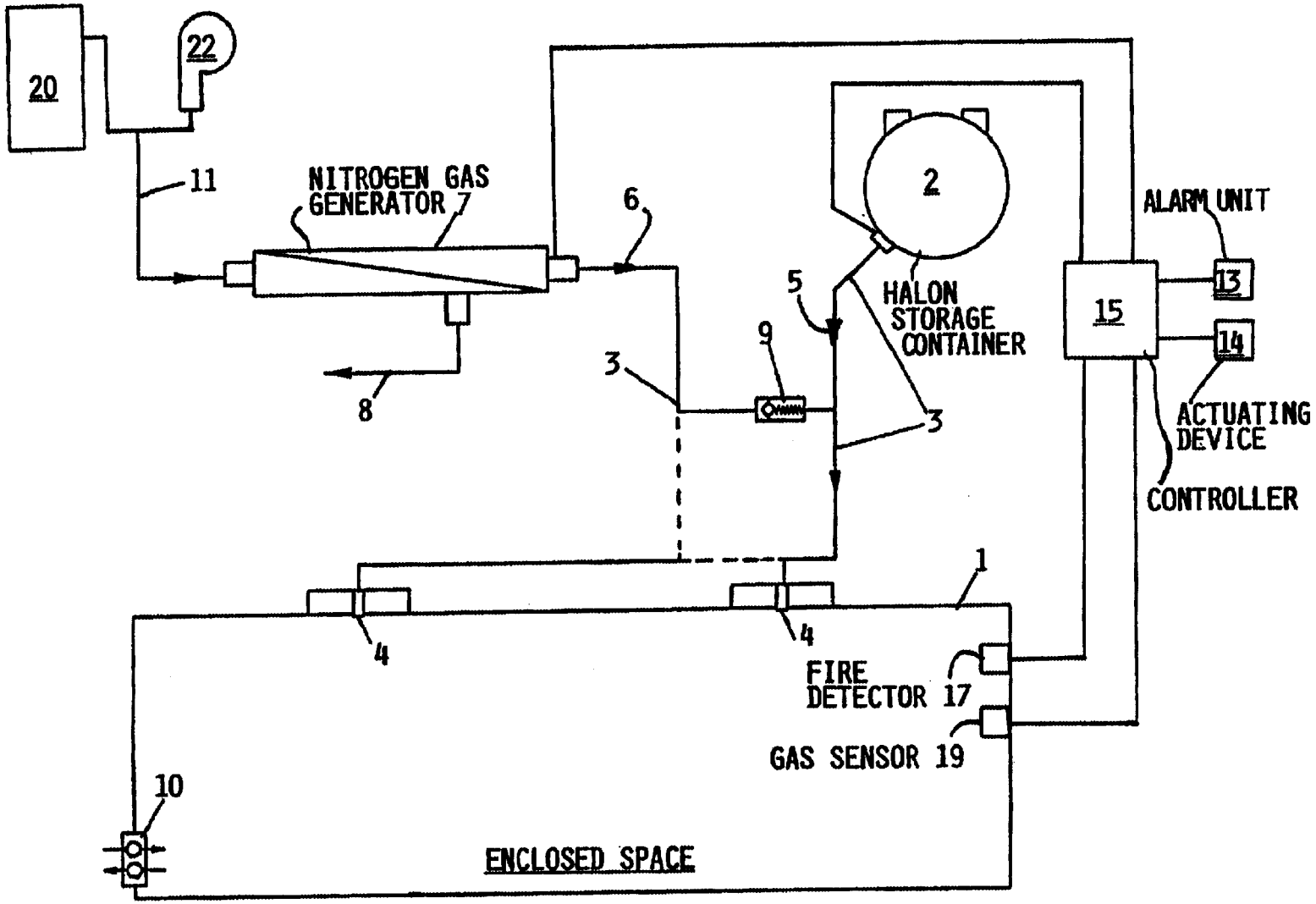
ALARM UNIT
13
14
ACTUATING DEVICE
CONTROLLER
15
2
HALON STORAGE CONTAINER
3
5
9
6
3
NITROGEN GAS GENERATOR
7
8
22
11
20
1
17
19
FIRE DETECTOR
GAS SENSOR
4
4
ENCLOSED SPACE
10

SYSTEM FOR EXTINGUISHING AND SUPPRESSING FIRE IN AN ENCLOSED SPACE IN AN AIRCRAFT

PRIORITY CLAIM

This application is based on and claims the priority under 35 U.S.C. §119 of German Patent Application 101 52 964.3, filed on Oct. 26, 2001, the entire disclosure of which is incorporated herein by reference.

FIELD OF THE INVENTION

The invention relates to a system for extinguishing a fire that has broken out in an enclosed space, such as the passenger cabin or a freight compartment in a passenger aircraft, and then achieving ongoing fire suppression.

BACKGROUND INFORMATION

A great variety of different systems using different extinguishing agents are known for fighting fires, i.e. extinguishing and/or suppressing fires, in different situations or applications. For example, at the present date, fires in aircraft are typically combated by a space flooding system using Halon 1301 as the extinguishing agent. In the field of fire protection in buildings and in marine applications, systems using water sprinklers or spray nozzles, or carbon dioxide ($CO_2$) extinguishing systems are typically used. In various industrial applications, and especially in spaces containing sensitive electronics or other technical equipment, for example computer systems and installations, fire extinguishing is now typically carried out by means of carbon dioxide ($CO_2$) since the use of Halon has been banned.

A method and system for suppressing or extinguishing a fire in an enclosed space is described in the German Patent Laying-Open Document DE 100 51 662 A1 (published May 8, 2002), and in the corresponding counterpart U.S. Published Application U.S. Ser. No. 2002/0070035 A1 (published Jun. 13, 2002), the entire disclosure of which is incorporated herein by reference. In the system and method according to that publication, nitrogen is introduced into the enclosed space in order to displace the oxygen required for sustaining the fire, whereby the fire is extinguished and/or suppressed. Particularly, the method and system according to the above publication aim to achieve a rapid extinguishing of the fire as well as an ongoing fire suppression in the enclosed space during a nearly unlimited time period after a fire has broken out. After detection of a fire in the enclosed space, the initial concentration of the nitrogen inert gas within the enclosed space is rapidly increased in a sudden shock-like manner, such that the oxygen content in the air within the enclosed space is rapidly reduced to a maximum oxygen concentration that is effective for extinguishing the fire. Preferably, the oxygen content within the enclosed space is reduced to and maintained at approximately 12 vol. %. Then, for maintaining this maximum oxygen concentration effective for fire extinguishing or suppression, nitrogen is continuously supplied in a prescribed quantity or prescribed rate into the enclosed space. To provide these two different phases or rates of supplying nitrogen, the system preferably includes nitrogen tanks or nitrogen generators to rapidly supply a limited quantity of nitrogen with a high flow rate, as well as a membrane system to supply an essentially unlimited quantity of nitrogen for a long duration at a lower supply rate.

Published European Patent Application EP 0,234,056 A1 discloses an extinguishing system for extinguishing a fire that has broken out in a passenger cabin or a cargo space of a passenger aircraft. The disclosed fire extinguishing system includes a supply container for storing and supplying pressure-liquified Halon, which may be supplied from the container through a duct system to extinguishing nozzles arranged in the passenger cabin or the cargo space. Thus, the Halon is supplied through the extinguishing nozzles into the cabin or the cargo space in order to establish an effective concentration thereof for extinguishing the fire in a relatively short time.

German Patent DE 41 22 446 C2 discloses a system for fire and explosion prevention, as well as breathing air supply for personnel, in armored vehicles such as military tanks. This system includes an air separating device that separates an airflow of the ambient air into a first oxygen enriched airflow that is provided to air breathing masks for the armored vehicle personnel, and a second nitrogen enriched airflow that is delivered into the interior space of the vehicle as well as interior spaces of containers therein, for fire and explosion prevention, whereby air inlets are connected to the respective spaces.

German Patent DE 198 24 300 C1 discloses a fire suppression system for rapidly evolving and progressing fires in a volume space that is to be monitored, which comprises one or more extinguishing agent containers, which contain a gaseous halogenated hydrocarbon as the extinguishing agent. The system further includes a monitoring and control arrangement that monitors the volume space and accordingly controls the fire suppression system, e.g. to actuate the system so as to distribute the extinguishing agent into the volume space through respective extinguishing agent distributor nozzle arrangements connected to the extinguishing agent storage containers.

U.S. Pat. No. 4,643,260 (Miller) discloses a fire suppression system including two Halon storage bottles, wherein the first bottle relatively rapidly discharges Halon and the second bottle relatively slowly discharges Halon, in order to rapidly achieve an initial higher Halon concentration and to thereafter maintain a somewhat lower Halon concentration in the enclosed space in which a fire is to be suppressed. The disclosed system also includes a molecular sieve as a filter and dryer in the duct between the second bottle and a flow regulator, to trap particles and to adsorb water from the extinguishant.

While the above described systems have all been found to be effective at extinguishing or suppressing fires in enclosed spaces, it has been found that improvements are still possible, particularly in view of the special considerations that apply for fire suppression and extinguishing in an aircraft. For example, Halon systems necessarily have a limited supply of the Halon extinguishing agent, so they are able to provide fire suppression for only a limited duration. Also, carrying along the stored Halon supply is a constant weight penalty, which is a critical consideration in the operation of a commercial aircraft. The Halon agent is also relatively expensive, and presents health risks at high concentrations. On the other hand, the Halon agent has been found to be fast-acting and highly effective at extinguishing and suppressing fires in enclosed spaces. In comparison, a fire suppression system using only nitrogen as the extinguishing agent is generally not as rapidly acting, and the nitrogen must be provided in a higher concentration (in comparison to Halon) in the enclosed space in order to be effective. Advantageously, however, the nitrogen gas as an extinguishing agent can be continuously provided in an essentially unlimited quantity, and does not need to be stored and carried constantly in the aircraft. There is no known fire combating system that avoids the various disadvantages, yet achieves the various advantages of the different known fire suppression and extinguishing agents.

SUMMARY OF THE INVENTION

In view of the above, it is an object of the invention to provide a system and method for extinguishing and suppressing fires in an enclosed space, which uses different extinguishing agents in combination or in succession. It is a further object of the invention to provide a fire extinguishing and suppression system and method that achieve a rapid fire extinguishing or flame knockdown, together with a long-term continuous fire suppression thereafter. The invention further aims to avoid or overcome the disadvantages of the prior art, achieve the advantages of the prior art, and achieve additional advantages, as apparent from the present specification. The attainment of these objects is, however, not a required limitation of the claimed invention.

The above objects have been achieved according to the invention in a system and method for extinguishing and suppressing a fire in an enclosed space, such as a passenger cabin or a freight or cargo hold in an aircraft. Throughout this specification, the terms "fire extinguishing" and "fire suppression" both refer to the acts of reducing or entirely putting-out a fire, and do not absolutely require entirely putting-out a fire. Generally, the term "fire extinguishing" refers to the initial flame knockdown and reducing the intensity of an existing fire, and the term "fire suppression" refers to the further reduction, the prevention of renewed flare-ups, and the prevention of further spreading of a fire, after the initial flame knockdown and fire extinguishing. The term "enclosed space" does not require absolute complete enclosure or hermetic sealing of the space, but rather refers to any space that is sufficiently enclosed to be able to establish and maintain a specified gas atmosphere therein. The term "duct" refers to any duct, pipe, hose, channel, conduit, tube, or the like that is suitable for conveying a gas therethrough.

According to the invention, the fire extinguishing and suppression system includes extinguishing nozzles arranged in the enclosed space, a Halon storage container that contains a Halon or a Halon substitute as a first extinguishing agent, a nitrogen generator that provides nitrogen or a nitrogen-containing gas as a second extinguishing agent, and a duct system that connects the Halon storage container and the nitrogen generator to the extinguishing nozzles. With this system, the first extinguishing agent (e.g. Halon), and the second extinguishing agent (e.g. nitrogen-containing gas) can be supplied together, in succession, or in alternation through the extinguishing nozzles into the enclosed space, in order to extinguish and then suppress a fire detected in the enclosed space. Particularly, the Halon is delivered first to rapidly extinguish the fire in the enclosed space, and the nitrogen-containing gas, and especially nitrogen enriched air, is delivered for a long time following the detection of a fire in order to displace the oxygen required for maintenance of the fire, so as to achieve a long-term fire suppression in the enclosed space.

According to preferred detailed embodiment features of the invention, the nitrogen generator can be embodied as an air separation module, especially comprising a molecular sieve, that separates an inlet flow of air into a nitrogen enriched airflow as the second extinguishing agent, and an oxygen enriched airflow that can be exhausted or delivered to breathing gas masks. The inlet airflow of the air separation module can be provided by bleed air from an aircraft engine, or from a blower of an aircraft air conditioning system.

The first extinguishing agent comprises a Halon (such as Halon 1301(TM)—trifluorobromomethane, bromotrifluoromethane; or Halon 1211(TM)—bromochlorodifluoromethane) or an adequate, tested, and accepted Halon substitute (for example FM200/FE36). Advantageously according to the invention, the concentration of the first extinguishing agent effective for fire extinguishing or suppression can be established within a relatively short time in the enclosed space. This effective fire extinguishing concentration of Halon or a Halon substitute is very small relative to the effective fire extinguishing concentration of other extinguishing agents such as carbon dioxide, argon, or nitrogen. Thus, the initial introduction of the first extinguishing agent (e.g. Halon) achieves the initial flame knockdown or extinguishing of the fire rather quickly, i.e. once the first extinguishing agent has become distributed uniformly throughout the enclosed space to achieve the required effective fire extinguishing concentration thereof.

During the introduction of the first extinguishing agent, or following the uniform disbursement thereof in the enclosed space, the second extinguishing agent comprising a nitrogen-containing gas or nitrogen enriched air is introduced into the enclosed space to establish an effective fire extinguishing or suppressing concentration of nitrogen and a corresponding effective low concentration of oxygen in the enclosed space. This advantageously provides a continuous long-term fire suppression.

The result is a mixture of gas in the enclosed space, comprising the Halon or Halon substitute gas and nitrogen enriched air. At every point in time during the fire suppression phase, the concentration of this gas mixture must be maintained above a certain minimum concentration, and correspondingly the concentration of oxygen in the enclosed space must be maintained below a certain maximum oxygen concentration, so as to achieve the desired fire suppression. The extinguishing system must thus be dimensioned, configured and designed to initially establish and essentially continuously maintain the required mixed gas concentration in the enclosed space, in consideration of the given volume of the enclosed space.

As an example application of the inventive fire extinguishing and suppressing system to combat a fire in a freight or cargo compartment of an aircraft, a fire combating process can be carried out, for example, as follows. Any conventional fire detection system initially detects the existence of a fire, and initiates a corresponding fire alarm signal to alert the cockpit crew. In response thereto, the cockpit crew activates the fire extinguishing and suppressing system. Under certain extreme conditions, the fire extinguishing and suppressing system could be activated automatically by the fire detection system, without intervention or action by the cockpit crew. Upon activation, the fire extinguishing and suppressing system introduces Halon 1301 or a Halon substitute gas into the cargo compartment to establish the prescribed effective design concentration of Halon therein. Simultaneously, or at a time delay after the introduction of the first extinguishing agent (Halon), or after a sensor senses that the required concentration of Halon has been established or that the concentration of Halon is diminishing, the nitrogen generator is activated so that the air separation module supplies nitrogen enriched air into the cargo compartment so as to make the environment therein inert. Nitrogen enriched air is continuously supplied from the nitrogen generator into the cargo compartment to achieve ongoing extinguishing and/or suppression of the fire until the aircraft lands and ground-based fire fighting equipment and crews take over the further fire fighting efforts.

With the above features, the invention achieves a combination of many of the advantages of various prior art fire extinguishing systems, while avoiding most of the disadvantages thereof. For example, the invention uses only gaseous extinguishing agents, which ensures a good distribution of the extinguishing agent throughout the enclosed space, without leaving behind any residues, moisture or other contamination in the enclosed space. This avoids the need of complex, time consuming and costly cleaning efforts in the event of an inadvertent unnecessary triggering of the fire extinguishing system. Another advantage is the on-board generation of the second extinguishing agent during the operation of the system, so that it is unnecessary to store a large amount of the extinguishing agents, while still achieving very long (essentially indefinite) fire suppression durations with a comparatively small overall system mass. On the other hand, the limited quantity of the first extinguishing agent is rapidly available to rapidly initiate the fire extinguishing process, in combination with the long-term availability of the second extinguishing agent which is continuously generated and supplied during the process. The use of environmentally friendly extinguishing agents is also advantageous.

BRIEF DESCRIPTION OF THE DRAWING

In order that the invention may be clearly understood, it will now be described in connection with an example embodiment thereof, with reference to the accompanying drawing, of which the single FIGURE is a schematic diagram of the arrangement of the most significant components of a fire extinguishing and suppression system according to the invention.

DETAILED DESCRIPTION OF A PREFERRED EXAMPLE EMBODIMENT AND OF THE BEST MODE OF THE INVENTION

As shown in the single drawing FIGURE, the inventive fire extinguishing and suppression system is provided for extinguishing and suppressing a fire that has broken out or erupted within an enclosed space 1, such as a passenger cabin or a freight or cargo hold of an aircraft. The presence of the fire is detected by a fire detector 17, which may comprise any conventionally known type of fire detector, such as a smoke sensor, a heat sensor, a gas sensor or the like. The fire detector 17 provides a corresponding signal to a controller 15, which in turn triggers an alarm signal in the event the existence of a fire is indicated by the fire detector signal. The alarm signal is audibly and/or visibly indicated by an alarm unit 13 such as a warning buzzer, bell or chime and a light or a visual display in the cockpit of the aircraft. Upon being warned of the existence of a fire by the alarm unit 13, the cockpit crew, or an automated controller such as a computer, can trigger an actuating device such as an actuating switch 14, which triggers the controller 15 to initiate a fire extinguishing and suppressing process by the fire extinguishing and suppressing system.

The system comprises a storage container 2 that contains a pressurized and thereby pressure-liquified Halon agent (preferably Halon 1301), or an acceptable Halon substitute (e.g. FM200/FE36), as a first extinguishing agent 5. The system further comprises a nitrogen generator 7 that generates and supplies a nitrogen-containing gas, and preferably nitrogen enriched air, as a second extinguishing agent 6. Extinguishing nozzles 4 are arranged at distributed locations in the enclosed space 1, and a duct system 3 of pipes, hoses, conduits, etc. connects both the Halon storage container 2 and the nitrogen generator 7 to the extinguishing nozzle 4. Preferably, both the Halon storage container 2 and the nitrogen generator 7 are connected in common to all of the nozzles 4 by the duct system 3. Alternatively, the duct system 3 may include separate or independent ducts that independently connect the Halon storage container 2 to a first set of the nozzles 4, and independently connect the nitrogen generator 7 to a second set of the nozzles 4. This is indicated by the dashed line portions of the duct system 3, whereby either respective one of the two dashed line duct portions is connected through, in the respective two alternative embodiments.

To actuate the fire extinguishing and suppression process, the controller 15 sends an actuating signal to the Halon storage container 2, so as to open a closure thereof, e.g. an actuatable valve, a rupturable membrane, or an explodable squib closure. Thus, the first extinguishing agent 5 (e.g. Halon) is supplied at a rather high flow rate from the container 2 so as to rapidly flood the first extinguishing agent 5 through the duct system 3 and the connected extinguishing nozzles 4 into the enclosed space 1. The concentration of the first extinguishing agent 5 is thereby rapidly built up in a shock-like or step-like manner in a short time in the enclosed space 1, to quickly establish the effective concentration thereof required for fire extinguishing.

The respective extinguishing agent very quickly takes effect by its intended influence on the combustion reaction of the fire. For example, the predominant extinguishing effect of Halon 1301 is the inhibition of combustion in a homogeneous phase, particularly by the removal of free radicals from the combustion chain reaction. On the other hand, the known Halon replacements are generally effective predominantly by oxygen displacement and by cooling of the combustion reaction.

Although the first extinguishing agent 5 can be rapidly supplied in order to quickly establish the required effective concentration thereof in the enclosed space 1, the supply quantity thereof is limited, so the duration of fire extinguishing with the first extinguishing agent 5 is also limited, by the storage volume of the Halon storage container or containers 2.

To achieve longer term fire extinguishing and suppression, the controller 15 sends an activation signal to the nitrogen generator 7, so that the nitrogen generator 7 generates and supplies the nitrogen-containing gas (especially nitrogen enriched air) as the second extinguishing agent 6 via the duct system 3 through the extinguishing nozzles 4 into the enclosed space 1. The nitrogen generator 7 preferably comprises an air separator module which receives an inlet flow of atmospheric air through an air inlet line or duct 11, and separates this inlet airflow into a nitrogen enriched airflow as the second extinguishing agent 6, and an oxygen enriched airflow that is exhausted as a byproduct or waste product through the outlet or exhaust duct 8, or which could alternatively be supplied to breathing air masks for persons in the aircraft, for example. A non-return valve 9 is preferably interposed in the duct system 3 between the nitrogen generator 7 and a duct branch through which the Halon storage container 2 joins the duct system 3. The non-return valve 9 ensures a one-directional flow of the nitrogen-containing second extinguishing agent 6 from the nitrogen generator 7 to the extinguishing nozzles 4, without allowing any backflow of Halon-containing first extinguishing agent 5 back into or through the nitrogen generator 7

The air separation module of the nitrogen generator 7 is preferably embodied to comprise a molecular sieve, for example including a membrane layer applied onto porous hollow fibers, whereby the membrane layer is selectively or preferentially permeable by different gas components of atmospheric air. Thereby, the molecular sieve preferentially separates nitrogen from atmospheric air, so as to produce the nitrogen enriched airflow as the second extinguishing agent 6, and the oxygen enriched exhaust airflow through the outlet duct 8. To operate the air separation module, the inlet airflow can be provided to the inlet duct 11, for example, in the form of engine bleed air that is supplied at a prescribed pressure from the compressor stages of the aircraft turbine engines 20. As an alternative, a blower 22 of the aircraft air conditioning system can be connected to the air inlet duct 11 to provide the pressurized inlet air for the air separation module.

Since the air separation module continuously generates the output flow of nitrogen enriched air as the second extinguishing agent 6, this can provide an essentially indefinite long-term fire suppression in the enclosed space 1, as long as a sufficiently high nitrogen concentration, and thereby a sufficiently low oxygen concentration, is established and maintained in the enclosed space 1.

The two extinguishing agents 5 and 6 may be provided simultaneously from the beginning of a fire extinguishing and suppressing process, under the control of the controller 15. Alternatively, the first extinguishing agent 5 (Halon) is provided initially by itself to establish the initial fire extinguishing concentration of Halon in the enclosed space 1. Thereafter, the second extinguishing agent (nitrogen enriched air) 6 is supplied to establish and maintain the effective fire suppressing concentration of nitrogen in the enclosed space 1 for continuing the fire suppressing effect over a long duration. The delayed provision of the second extinguishing agent 6 after the first extinguishing agent 5 can be achieved by a pre-specified time delay which is controlled by a timer in the controller 15. Alternatively, the activation of the nitrogen generator 7 can be triggered by other means, for example when a gas sensor 19 in the enclosed space 1 indicates that the first extinguishing agent 5 (Halon) has achieved the required Halon concentration for the initial fire extinguishing effect, or after such a gas sensor 19 detects that the concentration of Halon had reached the required initial level, but is then diminishing below a maintenance threshold. Thus, the nitrogen-containing second extinguishing agent 6 can be introduced as the effectiveness of the initial flood of Halon-containing first extinguishing agent 5 is diminishing.

Since the second extinguishing agent 6 will be continuously supplied for a long time, it is important to prevent an unintended pressure increase and risk of bursting of the enclosed space 1. For this purpose, at least one pressure relief valve or pressure compensation device 10 is arranged between the interior and the exterior of the enclosed space 1 to allow controlled pressure venting of the enclosed space 1.

The invention has been described predominantly in connection with a fire extinguishing and suppression system in an aircraft, but is not limited to that application. Instead, the inventive system may alternatively be used for extinguishing and suppressing fires in enclosed spaces in the cargo and machine spaces of ships, industrial production spaces, testing and experimenting spaces and laboratories, businesses, archives, libraries, galleries, museums, and military buildings and equipment. Also, further features can be incorporated in or combined with the present fire extinguishing and suppressing system, from the related disclosure of Published U.S. patent application U.S. Ser. No. 2002/0070035 A1, which is incorporated herein by reference.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed:

1. A system for extinguishing and suppressing a fire in an enclosed space, comprising:

at least one extinguishing nozzle arranged in the enclosed space;

a storage container containing therein a pressurized first extinguishing agent comprising at least one of a Halon and a Halon substitute;

a nitrogen generator adapted to generate a second extinguishing agent comprising a nitrogen-containing gas;

a duct system connecting said storage container and said nitrogen generator to said at least one extinguishing nozzle; and non-return valve interposed in said duct system between said nitrogen generator and a duct junction at which said nitrogen generator and said storage container are joined in common to said duct system.

2. The system according to claim 1, further in combination with an aircraft, wherein said enclosed space is a freight or cargo hold or a passenger cabin of said aircraft.

3.The system according to claim 1, wherein said duct system connects both said storage container and said nitrogen generator in common to a respective selected extinguishing nozzle among said at least one extinguishing nozzle.

4. The system according to claim 1, wherein said first extinguishing agent consists of a Halon.

5.The system according to claim 1, wherein said nitrogen generator comprises an air separation module comprising an air separator adapted to preferentially separate nitrogen from atmospheric air, an air inlet arranged to supply atmospheric air to said air separator, and a first outlet connected to said duct system to supply nitrogen enriched air from said air separator to said duct system, wherein said second extinguishing agent consists of said nitrogen-containing gas which consists of said nitrogen enriched air.

6. The system according to claim 5, further in combination with an aircraft including a turbine engine with an engine bleed air outlet port, wherein said engine bleed air outlet port is connected to said air inlet of said air separation module to supply thereto engine bleed air as said atmospheric air.

7. The system according to claim 5, further in combination with an aircraft including an air conditioning system with a blower, wherein said blower is connected to said air inlet of said air separation module to supply thereto pressurized air from said air conditioning system as said atmospheric air.

8. The system according to claim 5, wherein said air separation module further comprises a second outlet communicating with said air separator to supply oxygen enriched air as a byproduct from said air separator through said second outlet.

9. The system according to claim 5, wherein said air separator comprises a molecular sieve.

10. The system according to claim 1, wherein said non-return valve is interposed in said duct system between said nitrogen generator and said at least one extinguishing nozzle.

11. The system according to claim 1, further comprising a pressure compensating valve interposed between said enclosed space and an environment outside of said enclosed space.

12. The system according to claim 1, further comprising a controller connected for control signal transmission to said nitrogen generator and to said storage container.

13. The system according to claim 12, wherein said controller includes a timer, which activates said nitrogen generator at a specified time delay after activating said storage container, so as to provide said second extinguishing agent to said at least one extinguishing nozzle at said specified time delay after commencing to provide said first extinguishing agent to said at least one a extinguishing nozzle.

14. The system according to claim 1, wherein said storage container is able to supply said first extinguishing agent via said duct system through said at least one nozzle into said enclosed space so as to establish in said enclosed space a first effective concentration of said first extinguishing agent effective for extinguishing a fire, more quickly than said nitrogen B generator is able to supply said second extinguishing agent via said duct system through said at least one extinguishing nozzle into said enclosed space so as to establish in said enclosed space a second effective concentration of said second extinguishing agent effective for extinguishing a fire; and wherein said nitrogen generator is able to supply said second extinguishing agent during a longer time duration than said storage container is able to supply said first extinguishing agent.

15. A method of extinguishing and suppressing a fire in an enclosed space, comprising the steps:

a) detecting a fire in an enclosed space;

b) supplying a Halon or a Halon substitute into said enclosed space after said step a), so as to establish in said enclosed space a first effective concentration a of said Halon or Halon substitute that is effective to extinguish or suppress said fire; and c) generating nitrogen enriched air and supplying said nitrogen enriched air into said enclosed space after said step a), so as to establish and maintain in said enclosed space a second effective concentration of said nitrogen enriched air that is effective to extinguish or suppress said fire;

wherein said steps b) and c) are initiated simultaneously.

16. The method according to claim 15, wherein said step c) is carried out for a longer duration than said step b).

17. The system method according to claim, wherein said first effective concentration is established in said step b) more quickly than said second effective concentration is established in said step c).

18. A system for extinguishing and suppressing a fire in an enclosed space, comprising:

at least one extinguishing nozzle arranged in the enclosed space;

a storage container containing therein a pressurized first extinguishing agent comprising at least one of a Halon and a Halon substitute;

a nitrogen generator adapted to generate a second extinguishing agent comprising a nitrogen-containing gas;

a duct system connecting said storage container and said nitrogen generator to said at least one extinguishing nozzle; and a controller connected for control signal transmission to said nitrogen generator and to said storage container, wherein said controller is embodied and adapted to simultaneously activate said nitrogen generator and said storage container, so as to respectively provide said is second extinguishing agent and said first extinguishing agent simultaneously to said at least one extinguishing nozzle.

19. The system according to claim 18, wherein said duct a system includes separate ducts that respectively independently connect said storage container to a first extinguishing nozzle among said at least one extinguishing nozzle and independently connect said nitrogen generator to a second extinguishing nozzle among said at least one extinguishing nozzle.

20. The system according to claim 18, further in combination with an aircraft including an air conditioning system with a blower, wherein said blower is connected to an air inlet of said nitrogen generator to supply thereto pressurized air from said air conditioning system, from which pressurized air said nitrogen generator is adapted to generate said nitrogen-containing gas.

21. The system according to claim 18, further in combination with an aircraft, wherein said enclosed space is a freight or cargo hold or a passenger cabin of said aircraft.

22. A system for extinguishing and suppressing a fire in an enclosed space, comprising:

at least one extinguishing nozzle arranged in the enclosed space;

a storage container containing therein a pressurized first extinguishing agent comprising at least one of a Halon and a Halon substitute;

a nitrogen generator adapted to generate a second extinguishing agent comprising a nitrogen-containing gas;

a duct system connecting said storage container and said nitrogen generator to said at least one extinguishing nozzle;

a controller connected for control signal transmission to said nitrogen generator and to said storage container; and a gas sensor arranged in said enclosed space and connected to said controller, so that said controller activates said nitrogen gas generator responsive to and dependent on a concentration of said first extinguishing agent in said enclosed space after activating said storage container.

23. The system according to claim 22, wherein said duct system includes separate ducts that respectively independently connect said storage container to a first extinguishing nozzle among said at least one extinguishing nozzle and independently connect said nitrogen generator to a second extinguishing nozzle among said at least one extinguishing nozzle.

24. The system according to claim 22, further in combination with an aircraft including an air conditioning system with a blower, wherein said blower is connected to an air inlet of said nitrogen generator to supply thereto pressurized air from said air conditioning system, from which pressurized air said nitrogen generator is adapted to generate said nitrogen-containing gas.

25. The system according to claim 22, further in combination with an aircraft, wherein said enclosed space is a freight or cargo hold or a passenger cabin of said aircraft.

* * * * *

UNITED STATES PATENT AND TRADEMARK OFFICE

CERTIFICATE OF CORRECTION

PATENT NO. : 6,676,081 B2
DATED : January 13, 2004
INVENTOR(S) : Grabow et al.

It is certified that error appears in the above-identified patent and that said Letters Patent is hereby corrected as shown below:

Column 6,
Line 1, after “extinguishing”, replace “nozzle” by -- nozzles --;

Column 8,
Line 8, after ‘claimed”, insert -- is --;
Line 21, before “non-return”, insert -- a --;

Column 9,
Line 14, after “one”, delete “a”;
Line 22, after “nitrogen”, delete “B”;
Line 39, after “concentration”, delete “a”;
Line 51, after “The”, delete “system”; after “claim”, insert -- 15 --;

Column 10,
Line 10, before “system”, delete “a”.

Signed and Sealed this

Fifteenth Day of June, 2004

JON W. DUDAS
*Acting Director of the United States Patent and Trademark Office*